US011649688B2

(12) United States Patent
Oag et al.

(10) Patent No.: US 11,649,688 B2
(45) Date of Patent: May 16, 2023

(54) TOOL FOR MANIPULATING A TARGET

(71) Applicant: SPEX CORPORATE HOLDINGS LIMITED, Aberdeenshire (GB)

(72) Inventors: James George Oag, Aberdeenshire (GB); Rae Andrew Younger, Aberdeenshire (GB)

(73) Assignee: SPEX CORPORATE HOLDINGS LIMITED, Aberdeen (GB)

( * ) Notice: Subject to any disclaimer, the term of this patent is extended or adjusted under 35 U.S.C. 154(b) by 1 day.

(21) Appl. No.: 17/268,982

(22) PCT Filed: Aug. 16, 2019

(86) PCT No.: PCT/GB2019/052309
§ 371 (c)(1),
(2) Date: Feb. 17, 2021

(87) PCT Pub. No.: WO2020/035700
PCT Pub. Date: Feb. 20, 2020

(65) Prior Publication Data

US 2021/0310325 A1 Oct. 7, 2021

(30) Foreign Application Priority Data

Aug. 17, 2018 (GB) ..... 1813446

(51) Int. Cl.
*E21B 29/02* (2006.01)

(52) U.S. Cl.
CPC ..... *E21B 29/02* (2013.01)

(58) Field of Classification Search
CPC ..... E21B 29/02; E21B 29/002; E21B 41/0078
See application file for complete search history.

(56) References Cited

U.S. PATENT DOCUMENTS 3,422,760 A * 1/1969 Mohaupt ..... E21B 43/263 102/326
6,702,009 B1 * 3/2004 Drury ..... E21B 29/02 166/212

(Continued)

FOREIGN PATENT DOCUMENTS

WO 2016079512 A1 5/2016
WO 2016139481 A1 9/2016

(Continued)

OTHER PUBLICATIONS

International Search Report and Written Opinion dated Dec. 6, 2019 for corresponding International Application No. PCT/GB2019/052309.

*Primary Examiner* — Christopher J Sebesta
(74) *Attorney, Agent, or Firm* — Tarolli, Sundheim, Covell & Tummino LLP

(57) ABSTRACT

A tool (1) for manipulating a target with combustion products from a propellant, includes a housing (2) defining a chamber (12), a propellant source located within the chamber (12), an ignition mechanism (28) for igniting propellant (26) at the propellant source, and at least one chamber outlet (30) for combustion products from the propellant source. The tool (1) is configured to automatically open the chamber outlet (30) from a closed condition, following ignition of the propellant (26) at the propellant source. Methods of manipulating a target using the tool are also described.

15 Claims, 10 Drawing Sheets

(56) References Cited

U.S. PATENT DOCUMENTS

| | | | | |
|---|---|---|---|---|
| 2004/0089450 | A1* | 5/2004 | Slade | E21B 41/0078 166/55.7 |
| 2012/0138302 | A1* | 6/2012 | Stehle | E21B 43/116 166/63 |
| 2015/0275642 | A1* | 10/2015 | Braithwaite | E21B 43/11 166/299 |
| 2016/0084055 | A1 | 3/2016 | Moore et al. | |

FOREIGN PATENT DOCUMENTS

| | | | |
|---|---|---|---|
| WO | 2016166531 | A2 | 10/2016 |
| WO | 2017199037 | A1 | 11/2017 |

* cited by examiner

TOOL FOR MANIPULATING A TARGET

FIELD

The present invention relates to the field of manipulation of a material with combustion products from a propellant. The present invention finds particular application in the oil and gas industry and is particularly suitable for the manipulation of solid material targets, such as tubulars.

BACKGROUND

There are situations in which it is desirable to manipulate a target particularly in remote locations such as inside an oil or gas well.

A typical situation may be to sever a tubular in a well, clean a downhole device or tubulars, initiate a downhole tool or remove an obstruction.

Conventional tools perform these operations with varying degrees of success but generally they are not particularly efficient and make such operations expensive and time consuming. They may, additionally, have associated ancillary equipment that is cumbersome or may attract stricter logistical or regulatory controls.

The present applicant's international patent application, published as WO2017/199037, describes making use of a stream of combustion products from a propellant source to carry out operations such as severing a tubular. There remains the desire for alternative and improved tools that may find use in challenging environments.

SUMMARY

According to a first aspect of the invention there is provided a tool for manipulating a target with combustion products from a propellant, the tool comprising:

a housing defining a chamber;

a propellant source located within the chamber;

an ignition mechanism for igniting propellant at the propellant source; and at least one chamber outlet for combustion products from the propellant source;

wherein the tool is configured to automatically open the chamber outlet from a closed condition, following ignition of the propellant at the propellant source.

The closed condition of the chamber outlet may be a sealed or substantially sealed condition, where at least ingress of fluid (gas or liquid) is prevented or substantially prevented. The tool may comprise a plurality of chamber outlets, each automatically opened following ignition of the propellant source.

The tool is configured to automatically open a chamber outlet from a closed condition, following ignition of propellant at the propellant source. The combustion products produced following ignition of propellant generate pressure and/or heat. The pressure and/or heat of these combustion products can cause the automatic opening of the chamber outlet or chamber outlets in various ways as described herein.

The tool is typically for use in downhole work in the oil and gas industry.

The term 'propellant source' used herein means a location of propellant material provided for ignition. Thus, a propellant source within the chamber may comprise or be a charge (portion) of a propellant composition, or components for a propellant composition, placed at a location within the chamber. Alternatively, a propellant source may be an opening into the chamber from a supply system that feeds propellant composition, or the components for a propellant composition, for ignition. Feeding the tool with propellant or propellant components allows the tool to be used continuously after ignition. The propellant may be fed into the housing in the form of a solid, liquid, paste, foam, gel or gas composition or a combination of these.

When a chamber outlet is opened the combustion products from the propellant can exit, as a stream of combustion products. The speed at which the propellant combustion products exit the tool may be subsonic, sonic or supersonic.

A chamber outlet may comprise or define a nozzle for directing combustion products at a target. Additional nozzle components may be fitted to a chamber outlet and constitute part of the nozzle. For example, the chamber outlet may be fitted with nozzle components that extend out from the tool so that combustion products from a deployed tool are directed more accurately and/or in a more focussed shape towards the target. More generally tools may be provided with a chamber outlet or outlets to which a range of nozzle components may be fitted, for example by screw fitting a threaded nozzle component to a corresponding threaded part of the chamber outlet or housing at the chamber outlet. The range of nozzle components can aid in reducing inventory. A 'standard' tool can be configured for a variety of tasks by fitting appropriate nozzle components and/or adjusting the propellant employed.

In use, the combustion products can, for example, manipulate a target, such as a tubular, by, for example, ablation, cutting, displacement, removal, heating, abrasion, or erosion and/or consuming. In some examples the material of the target may be oxidised (partially or fully) by the stream of combustion products. In some examples the stream of propellant combustion products, (which may be predominately gaseous), acts as a carrier to remove small particles of molten and/or oxidised material from the material of the target. The direction of the flow of the propellant combustion products can determine the flow of the material removed from the target. For example when cutting a tubular with a tool within a wellbore, the direction of flow is generally back into the wellbore whilst the cutting process takes place; and largely through the hole made in the tubular once the target has been cut).

This method is much faster than conventional processes leading to time and resource savings and associated reduced costs. The target may include more than the object immediately in front of the chamber outlet. For example, if the (initial) target is a tubular being severed by a tool placed inside it, the target may further include another tubular fitted about the initial target tubular. Other examples of targets having multiple layers which can be manipulated (e.g. cut) with combustion products from a tool placed within a target include casing, cement and rock formation/production tubing; and casing with space in between. All of these being within a drilled hole (normally filled with fluid such as water, gas, oil or drilling fluids). When the tool is deployed about the target for directing combustion products inwards, targets may include tubing such as coiled tubing, cables such as wax heating cables with a stainless steel outer sheath located within the coiled tubing, tool conveyance strings and the like.

The stream of combustion products can be controlled, for example, to cut to a particular depth, to flow with a particular intensity, to flow in a particular direction etc. The configuration of a chamber outlet, when open, can act as a control device.

Tools of the invention can be deployed for use by any suitable deployment mechanism and may therefore be fitted with or connected to suitable interfaces (for deployment, retrieval and communications). These deployment mechanisms may also include propellant and particle supply lines, for example, in oil and gas operations, from the rig floor to the tool location within the wellbore.

In oil and gas industry uses, these could be any one of coiled tubing, slickline, e-line, wireline, slimline, coil, drillpipe, tractor, robot and similar methods for deployment and use of tools in that industry. For other applications options for deployment may include by tractor, robot, autonomous vehicle (surface, air, sea, subsea and space), vehicles in general, crane lift and similar methods. Manual installation of a tool by one or more operatives is also contemplated ("manual" deployment).

The propellant source may comprise a portion of a propellant material i.e. a charge of propellant material. There may be more than one propellant source within the chamber. For example, two.

A propellant is a generally explosive material which has a low rate of combustion and once ignited deflagrates to produce propellant gas. This gas is highly pressurised, the pressure driving the gas and other combustion products away from the propellant, forming a flow (stream) of combustion products. A propellant can burn smoothly and at a uniform rate after ignition without depending on interaction with the atmosphere and produces propellant gas and/or heat on combustion and may also produce additional combustion products. The stream of combustion products can include both the combustion products resulting from the deflagration reaction of the propellant, and also partially combusted and uncombusted particles/materials from the propellant mixture employed. The stream of combustion products may include a plasma, where the temperature and pressure conditions developed allow it. The propellant may be a solid, liquid, paste, foam, gel or gas composition or a combination of these. A typical propellant may be a composition comprising an oxidant and a fuel that generates gas when ignited. Other components such as binders, catalysts and gelling agents may also be included. For example mixtures comprising potassium perchlorate (as oxidant) and aluminium (as fuel); or comprising ammonium perchlorate (as oxidant) and aluminium (as fuel) may serve. A binder such as hydroxyl-terminated polybutadiene (HTPB) may be used. For further example a monopropellant system, including a single compound that can act as a propellant, may be employed. Ammonium perchlorate can perform as a monopropellant, decomposing to provide combustion products.

Modifying agents may be present in the propellant employed or may be injected from a modifying agent injector into a stream of combustion products. For example, a modifying agent may be solid particles that are not consumed or may be partially consumed by the combustion process. For example a metal particle that is partially oxidised during the combustion process. Modifying agents can be particles of a single element or compound or may be mixtures of elements and/or compounds. Modifying agents may be reactive. For example modifying agents may be oxidants or provide a source of an oxidant that reacts with a target being manipulated. Solid particles can cause abrasion of the target material to be manipulated. Liquid droplets (e.g. of metal particles melted by the heat of the combustion of propellant) are also contemplated. Liquid droplets can cause erosion or ablation of the material to be manipulated. Liquid droplets can also provide good heat transfer to a target being manipulated.

The chamber, the propellant source and/or the propellant composition itself may include other materials, for example propellant modifiers to moderate or enhance the combustion reaction. For further example the chamber, the propellant source and/or the propellant composition itself may include particles that do not participate in the combustion process at the propellant source but are carried in the stream of combustion products.

The tool includes an ignition mechanism for igniting the propellant. The ignition mechanism may include an ignition device at each of the propellant sources where more than one is provided. The ignition devices may be controlled to ignite propellant at the respective propellant source simultaneously or substantially simultaneously. For example, a control signal (by wire or wireless) from outside the chamber may cause activation of the ignition device to ignite the propellant at each propellant source. However, it has been found that ignition at one propellant source in a chamber of the tool will tend to rapidly cause ignition at another or further propellant sources. Therefore, only one ignition device may be provided within the chamber.

The tool is configured to automatically open a chamber outlet from a closed condition, following ignition at the propellant source. On ignition of the propellant, the combustion products produced generate pressure and/or heat.

The housing may therefore have a wall portion that defines the opening and is removed by the action of the combustion products. For example, by ablation, cutting, displacement, removal, heating, abrasion, or erosion and/or consuming the material of the wall portion in a combustion reaction i.e. the chamber housing has a wall portion that is sacrificial.

Alternatively, the housing may have a sacrificial wall portion that is burst (broken) open by the action of the combustion products. The action opening the wall portion may include any one of, or any combination of, ablation, cutting, displacement, removal, heating, abrasion, erosion, consuming the material of the wall portion in a combustion reaction, or bursting open.

The remaining part of the housing wall or walls will typically be made of a material that is relatively resistant to being consumed or displaced; at least allowing the combustion products to achieve the intended action (via the chamber outlet), before succumbing. Alternatively, housing walls may be shielded from propellant sources, for example by an internal wall or walls, so that the combustion products impinge on a selected portion of wall that is removed, displaced or burst open by their action.

The sacrificial wall portion may be of a material that is bonded, for example by adhesive or by a fusion method such as welding, to the remaining part of the housing wall or walls. The sacrificial wall portion may be a thinner portion of wall. For example, the wall of the chamber maybe formed to be thinner, or machined after making to be thinner at a selected location and in a selected shape. The thinner area will be preferentially removed by the action of combustion products following ignition of the propellant.

The wall portion may be a separate item, that may be fitted to the housing during assembly of the tool before use. In a convenient arrangement, the sacrificial wall portion constitutes a seal between two parts of the housing, before propellant at the propellant source is ignited. The seal may be held in place by clamping between the two parts of the housing.

For example, each housing part may have a sealing edge that may define an opening into a cavity that constitutes part of the chamber when the tool is assembled for use. Sealing edges may be circumferential i.e. running all around the opening. The wall portion may be a seal that clamps between the two parts of housing. The wall portion may be a circumferential seal, for example an annular sealing ring. The circumferential seal may seal between corresponding circumferential sealing edges of the housing parts. The circumferential seal may be cut, slotted or provided with one or more grooves (e.g. scored) to render it more friable. For example, a series of cuts or slots extending part way from the inner circumference towards the outer circumference of a sealing ring can be effective in adjusting the strength of the seal when acted on by the combustion products.

For example, the housing may be cylindrical or generally cylindrical in form when assembled. Two housing parts may each constitute part of the cylinder and have a first closed end and a second open end. The open end has a circumferential sealing edge defining a cavity within the housing part. A circumferential sealing ring is placed between the sealing edges of the housing parts and the housing parts clamped into sealing engagement with it. The chamber of the assembled tool comprises the two cavities of the housing parts. The chamber may itself take a cylindrical or generally cylindrical form, for example its shape may generally correspond to the outer shape of the cylindrical housing. The propellant source is within the chamber. On ignition of the propellant the pressure and/or heat of the combustion products act to remove the circumferential sealing ring leaving a circumferential opening or slit in the housing, part way along the length of the cylinder (for example at the midpoint), which is the chamber outlet for the combustion products. Thus, such a tool can project a stream of combustion products radially outwards, for example to cut or otherwise sever a tubular from the inside.

Alternatively, the housing may be cylindrical or generally cylindrical in form, but one of the two housing parts may be in the form of a disc and the other is cylindrical having a first closed end and a second open end. The disc has a circumferential sealing edge that corresponds to the circumferential sealing edge of the open end of the other the housing part. The disc and the cylindrical parts are clamped together with a circumferential sealing ring in between. The chamber comprises the cavity in the cylindrical housing part. On ignition of propellant, the pressure and/or heat of the combustion products leave a circumferential opening, at the disc end of the housing, that constitutes the chamber outlet from the housing for combustion products, allowing a stream of combustion products to interact with (manipulate) a target.

Where the wall portion is a seal between two parts of the housing, clamping together can be obtained in various ways. In a convenient arrangement the two parts of the housing may be mounted to a shaft configured to allow one part to be moved towards the other, along the shaft, clamping the seal in-between. One or both of the housing parts may have a threaded bore mounted to a threaded portion of the shaft, to allow a screwing together action. Alternatively, one or both housing parts may be mounted in sliding engagement to the shaft. Clamping force can be applied by means of e.g. a nut or a spring, acting along the shaft to urge one housing part towards the other.

Where a shaft mounts the two housing parts it may pass through each part. For example, where a cylindrical or generally cylindrical housing is formed the shaft may pass from one end of the cylinder through the chamber to the other. Conveniently the shaft can provide access to the interior of the tool for the ignition mechanism e.g. by being hollow. This hollow shaft may carry parts of the ignition mechanism, for example wiring, into the chamber. This can allow ignition to be controlled by wire from a distance.

The chamber includes a propellant source. The propellant source may comprise a solid propellant. Alternatively, or additionally, the propellant source may comprise a liquid, paste, foam, gel or gas propellant or a combination of these. The propellant source may be wholly contained within the chamber of the housing. Where the propellant source comprises a charge of propellant, it may be contained within its own housing, within the chamber of the tool.

In alternative embodiments, the propellant may be fed into the housing. Feeding the tool with propellant or propellant components allows the tool to be used continuously after ignition. The propellant may be fed into the housing in the form of a solid, liquid, paste, foam, gel or gas or a combination of these.

In some embodiments, the tool may further comprise at least one combustion chamber. Where more than one is employed they may be in series, with one in fluid communication with the next or in parallel. The combustion chamber may be within the housing chamber. For example, where the tool is fed with propellant or propellant components the supply system may feed the propellant or components for propellant into the combustion chamber constituting the propellant source. The combustion chamber has one or more combustion chamber outlets into the chamber (of the housing). The combustion chamber allows a controlled combustion reaction to occur, developing the desired combustion reaction in a relatively stable environment before release from the combustion chamber outlet(s) into the housing chamber and thence from the housing chamber outlet to manipulate a target.

The use of a combustion chamber may allow improved control of the combustion process and/or allow the process to be varied during the use of the tool—to develop desired temperature, pressure and/or combustion product characteristics for the task in hand. The desired temperature, pressure and/or combustion product characteristics may be changed over time if desired.

To that end the tool may be provided with a control system to control and/or monitor one or more of: feed of propellant or propellant components; temperatures; pressures (within the combustion chamber and/or within the chamber defined by the housing); and propellant combustion products. For example, the combustion chamber outlet(s) can act as a restriction or choke to the stream of combustion products. The choke maybe made variable and controlled by the control system.

Changing the combustion conditions and/or the configuration of the combustion chamber outlet(s) can be used to accelerate or decelerate the stream of combustion products.

The propellant may be formed by combining two or more materials within the tool or from outside the tool (when fed into the tool). The propellant source may be arranged to create an intermittent stream of combustion products. The propellant may be a single state, a solid, liquid, paste, foam, gel or gas or may be in two or more states. Alternatively, the propellant source may comprise propellants in separate states, which are combined at or prior to deflagration initiation. Alternatively, or additionally the propellant may change state prior to ignition. Once ignited, the propellant source may define a deflagration zone. More than one propellant source may be provided in the chamber. The propellant sources may be spaced apart one from the other. The propellant sources (for example two) may be spaced apart in the chamber with the chamber outlet in-between. Where more than one chamber outlet is provided at least one chamber outlet may be in-between spaced apart propellant sources. Alternatively, more than one or even all the chamber outlets may be in between spaced apart propellant sources.

In a convenient arrangement the propellant of the propellant source may be propellant composition divided into at least two portions or charges, spaced apart in the chamber (of the housing). The propellant may be a solid, liquid, paste, foam, gel or gas or a combination of these. A solid is convenient where the required charge of propellant for each propellant source can be fitted into the tool before deployment. On ignition of the propellant the flow of combustion products evolved from one propellant charge interacts with the flow of combustion products evolved from the other. This can aid in providing a powerful and directed jet of combustion products from the chamber outlet or outlets.

For example, the chamber may be a generally cylindrical void and have a chamber outlet part way along the length of the cylinder, A charge of propellant maybe placed at each end of the chamber, with the chamber outlet in-between. Such an arrangement may aid in directing the flow of combustion products from the chamber outlet as discussed in more detail hereafter and with reference to a specific embodiment.

In general, the chamber outlet may be a circumferential slit, providing a stream of combustion products emanating from all around the circumference of the housing. Such a '360 degree chamber outlet' may be useful, for example, when severing a tubular when the tool is placed inside it. Alternatively, the chamber outlet may provide alternative direction to the stream of combustion products. For example, the chamber outlet is a slit not around the complete circumference of the tool, but over a reduced angle, such as 90 degrees about the circumference. Such a tool may find use in severing a fitting such as a control line or cable located within a tubular. Chamber outlets are not particularly restricted in shape, they may take the form of circular holes or elongate slits for example. A group of chamber outlets may be provided to allow the stream of combustion products to interact with specific locations on a target. For example, to make 'cuts' (apertures, such as perforations, slots, and the like) at specific locations in the body of a tubular.

In an alternative form the tool may be generally tubular, for example cylindrical with an axially extending passage therethrough. In a tubular tool the chamber is located between the inner and outer walls. The chamber may extend around the whole circumference between the inner and outer walls. The chamber outlet or outlets from the chamber may be on the inner wall of the tubular so that the stream or streams of combustion products are directed generally inwards. A circumferential slit type of chamber outlet on the inner wall can be used to sever a cable or tubular about which the tool is fitted. Alternatively, the chamber outlet or outlets may be on the outer wall and so direct the combustion products generally outwards. A 360 degree chamber outlet on the outer wall of the tubular tool can be used to sever a tubular when the tool is placed inside it. Therefore, it may be convenient to make use of a tubular tool for either 'inwards' or 'outwards' cutting. Common parts may be employed for the tubular tool with the housing configured with the chamber outlet or outlets directed as suited to the intended task.

In addition to the size and shape of chamber outlets, and any associated nozzle components, other means can be used to control or direct the flow of combustion products.

Propellant charges may sit in a propellant housing within the chamber. The propellant housing has an open or openable end e.g. it may be in the form of a cup holding the propellant charge. The opening of the cup (housing end) is directed towards a chamber outlet so that the stream of combustion products produced following ignition of the propellant at the propellant source will emanate from the chamber outlet with direction and force controlled, at least to some extent, by the shape of the cup.

The propellant housing may be adjustable in the direction of the opening. For example, the propellant housing may be mounted on a joint such as a ball and socket type joint that allows directional movement. In use the direction of the opening in the propellant housing may be set before the tool is deployed to an in use position. Following ignition and automatic opening of the chamber outlet, the stream of combustion products is controlled by the configuration of the chamber outlet; and by the configuration of the propellant housing and direction of its opening. Alternatively, the direction of the opening in the propellant housing may be adjustable, (e.g. by electric motor drive), after deployment of the tool.

The tool may include a plurality of propellant sources which may be propellant charges in propellant housings. The propellant sources may each be directed to a respective one or a plurality of chamber outlets. For example, a tool may have chamber outlets arranged in spiral arrangements about the body of (typically cylindrical) housing. In that respect the arrangement can be similar to that found in the known tubing-conveyed perforating guns (TCP guns), TCP guns are widely used in oil and gas downhole situations, producing a number of shots (perforations) in a target per unit length of the tool. TCP guns use a number of explosive charges that typically employ the detonation of a high explosive charges to change a shaped charge liner, typically made of copper, into a high speed projectile. TCP guns require careful positioning of the shaped charges, both with respect to neighbouring charges and also the target. The TCP tool is open to the outside (i.e. well conditions) by having holes machined into the housing to allow the high speed projectile to reach its intended target with ease.

Propellant charges operate very differently to and can avoid some limitations of TCP guns. The propellant sources can be contained within a sealed conveyance system that is not open to well conditions. The propellant sources may be charges of propellant or may be fed with propellant from outside the housing, allowing longer production of combustion products.

In some arrangements, the combustion products from one propellant source can be directed to have little or even substantially no effect on neighbouring streams of combustion products from neighbouring propellant sources.

A tool making use of propellant sources can remove material from, for example, production tubing, casing, cement and/or rock formation or any other equipment in a wellbore. The propellant from propellant sources may produce cleaner perforations than those of TCP guns. The projectiles of TCP guns tend to compress the surrounding rock formation and leave the projectile material (e.g. copper) spread ('splattered) along the length of the perforation.

Other advantages of using propellant rather than high explosive/projectile arrangements can include the opportunity to make larger and longer holes or perforations.

As an alternative to the use of sacrificial wall portions that reveal the chamber outlet following ignition of propellant, the housing may be formed of two parts, moveable one relative to the other to reveal the chamber outlet or a plurality of outlets. The movement may be by the action of the combustion products produced by the ignition of propellant. One part may be a hinged wall portion that is opened about the hinge by the action of the combustion products, i.e. displaced to one side by the pressure of combustion products, to reveal the chamber outlet.

Alternatively, the two parts may move away from each other to reveal the chamber outlet or outlets. As the combustion products exit the outlet(s) the two parts of the housing may be kept in the open position by the pressure generated by the combustion products. The two parts of the housing may be prevented from moving further apart than desired by being tethered together, for example by a shaft connecting one to the other.

The two parts of the housing may have a sealing edge that may define an opening into a cavity that constitutes part of the chamber when the tool is assembled for use. Alternatively, one of the two housing parts may be in the form of an end having a sealing edge and the other has a corresponding sealing edge that defines an opening into a cavity that constitutes part or all of the chamber when the tool is assembled for use. Sealing edges may be circumferential i.e. running all around the opening. Such a tool may be provided with a seal that is clamped in use, between the two parts of housing. For example, a circumferential seal, for example an annular sealing ring. Alternatively, the sealing edges of the housing parts may be capable of sealing one to the other, a sealing compound such as a sealing grease may be employed in some examples.

Movement of the housing parts one relative to the other can be obtained in various ways. In a convenient arrangement the two parts of the housing may be mounted to a shaft configured to allow one part to be moved towards or away from the other, along the shaft. One of the housing parts may have a threaded bore mounted to a threaded portion of the shaft, to allow a screwing together action and application of a clamping force as desired. One or both housing parts may be mounted in sliding engagement to the shaft. A force clamping the housing parts together can be applied. For example, by means of a nut or a spring, acting along the shaft to urge one housing part towards the other.

Where a shaft mounts the two housing parts it may pass through each part. For example, where a cylindrical or generally cylindrical housing is formed the shaft may pass from one end of the cylinder through the chamber to the other. Conveniently the shaft can provide access to the interior of the tool for the ignition mechanism e.g. by being hollow. This hollow shaft may carry parts of the ignition mechanism, for example wiring, into the chamber. This can allow ignition to be controlled by wire from a distance.

To allow automatic movement of the housing parts following ignition, the clamping together force can be overcome by the pressure generated by the combustion products. For example, the pressure may overcome the clamping force of a spring.

For further example, where a housing part is moveable along a shaft it may be fixed at a position by mean of a stop, such as a split pin passing through the shaft. This allows the other housing part to clamp to it. Following ignition, the pressure in the chamber caused by combustion products overcomes the stop (e.g. breaks the split pin), allowing the housing parts to move apart, revealing a chamber outlet or outlets.

As a yet further example the two housing parts may be clamped together by means of an outer or an inner coupling. The coupling may be circumferential around the outside of the housing or circumferential around the inside of the chamber. The coupling may be a threaded coupling, screw fitting to both parts of the housing. An outer coupling is external to the housing, an inner coupling is within the chamber. The coupling can be threaded to accept corresponding threads provided on the housing parts, to allow the housing parts to be screwed together. Following ignition, the pressure of the combustion products urging the housing parts away from each other breaks the coupling, allowing the desired movement of the housing parts to open the chamber outlet(s).

An inner coupling can be convenient in assembly of the tool. The threading on one housing part may be opposite that of the other (i.e. left hand and right hand threads), to allow screwing the parts together and into sealing contact by turning in one direction only.

The chamber outlet or outlets revealed following ignition of the propellant in a tool of the invention may be a circumferential outlet directing the combustion products radially outwardly. For example, over a circle or part circle. Where the tool has a cylindrical or generally cylindrical housing the chamber outlet may be circumferential and have a principal direction for the combustion products of radially outwards at an angle substantially normal to the principal axis of the cylinder. (It will be understood that depending on the form of the chamber outlets, the combustion products may generally have a tendency to spread outwardly from their original direction as they exit the housing. The principal direction of the combustion products is the mean direction of flow). Alternatively, the chamber outlet may be circumferential but direct the combustion products at an angle to the normal as shown hereafter and with reference to a specific embodiment.

Other options for chamber outlets include a plurality of outlets revealed by the relative motion of two parts of the housing. For example, the housing may be a cylindrical or generally cylindrical and have two parts that have corresponding castellated sealing edges, that overlap and seal when the tool is assembled. Following ignition, the castellated edges move with their respective parts of the housing and reveal a succession of chamber outlets around a circumference of the tool.

According to a second aspect of the invention, there is provided a method for manipulating a target with combustion products from a propellant, the method comprising:

a) providing a tool comprising:
- a housing defining a chamber;
- a propellant source located within the chamber;
- an ignition mechanism for igniting propellant at the propellant source; and
- at least one chamber outlet for combustion products from the propellant source;
- wherein the tool is configured to automatically open the chamber outlet from a closed condition, following ignition of propellant at the propellant source;

b) locating the tool in proximity to the target; and c) igniting propellant with the ignition mechanism.

The method can make use of any or all of the optional features described herein for tools in accordance with the first aspect of the invention.

For example, two or more propellant sources may be provided, spaced apart one from the other and with the chamber outlet, or a plurality of outlets, in-between.

Housings for tools described herein may typically be formed of a metal or alloy, such as a steel for example. Housings may include a liner to act as heat shielding. A polymer composition, such as an elastomer and/or a phenolic composition may serve. Heat shields suitable for use in the space industry may also be used.

The outlet from a chamber may require components that are functional at high temperatures. Alloys such as rhenium alloys or TZM (titanium, zirconium, molybdenum) may be employed. Where liquid or gel type propellant compositions are employed the propellant sources may make use of platinum, or alloys of at least one of platinum, and niobium (columbium). Other materials may be used as liners where combustion temperatures may be experienced, for example copper, rhenium/tungsten or tungsten foams.

Other components such as pumps, motors, combustion chambers or injector units for use with liquid or gel propellant compositions or components for propellant compositions may employ metals such as stainless steels, copper, or suitable metal alloys.

The propellant ignitions mechanism may be any suitable ignition system for the propellant employed, such as those used in the oil and gas industry or the space industry to ignite combustible or explosive materials. Examples include, but are not limited to electric or other direct heating, non-explosive and explosive chemical ignition (such as propellants or other pyrotechnics), spark plug or other electric discharge, and the like.

Tools of the invention may also be fitted with one or more of:

- pressure relief means such as bursting discs.
- a cooling system. The cooling system may be supplied with a coolant, for example, water.
- a control system, such as the control and monitoring system discussed above in respect of embodiments including a combustion chamber. The control system may control the inflow of propellant from propellant supply lines and the outflow of the combustion products through and out of a combustion chamber, if employed. The control system may allow control of combustion products from the chamber outlets of the chamber of the housing, for example directional control over the combustion products.
- one or more injectors for modifying agents such as solid particles.
- one or more propellant supply lines.
- one or more propellant injection heads to inject propellant into the chamber (or into a combustion chamber, where one is employed).

DETAILED DESCRIPTION OF THE DRAWINGS

Figure 1B:
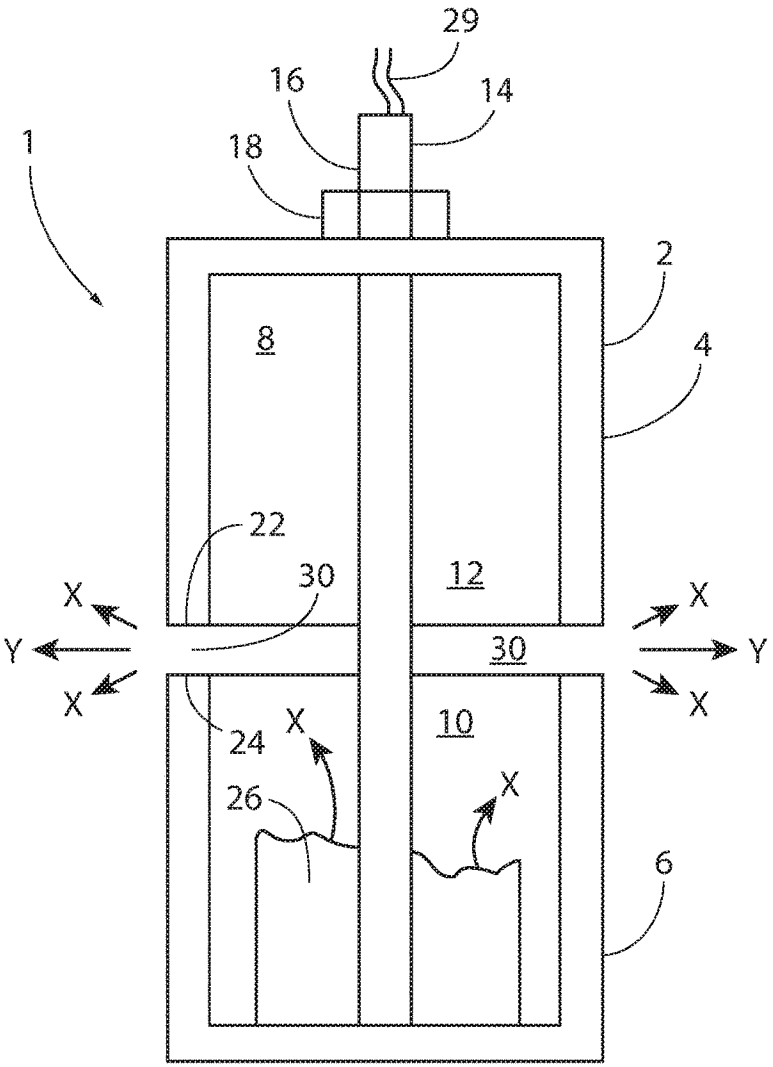
FIGS. 1A and 1B show in schematic cross section elevation a tool for manipulating a target with combustion products.
Figure 1A:
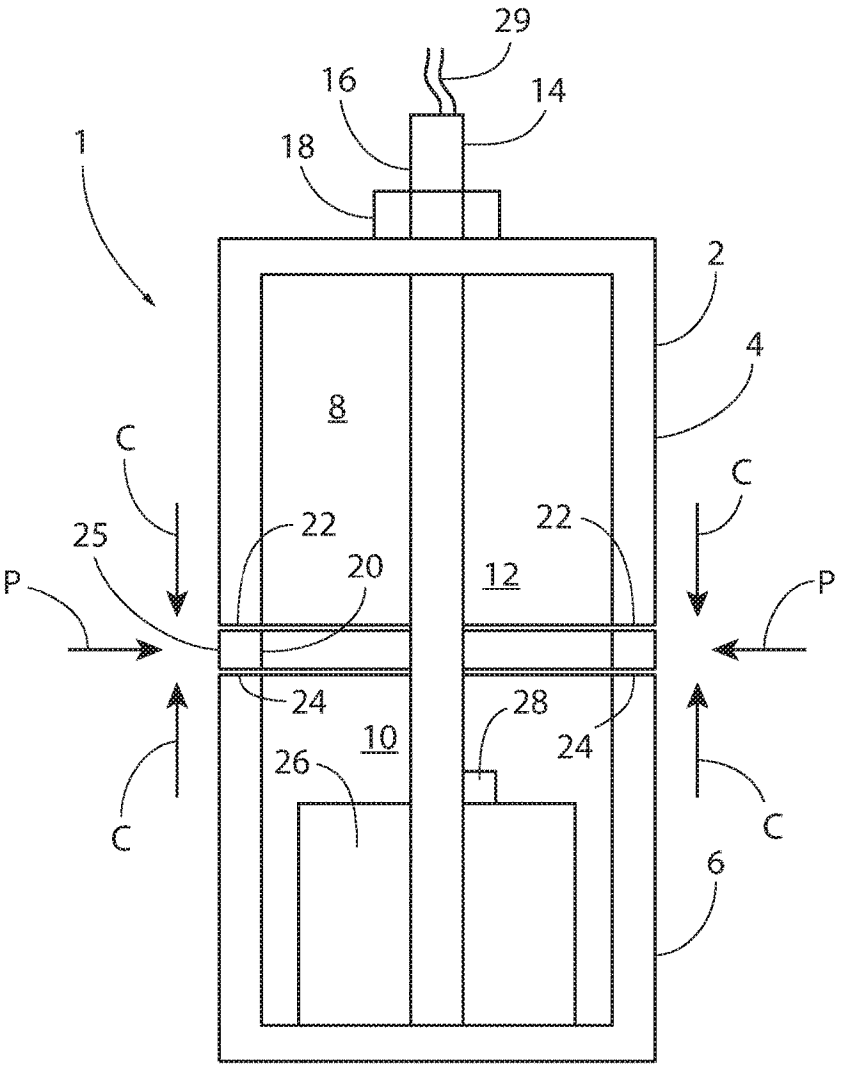

FIG. 1A shows in schematic cross section elevation a tool 1. The tool 1 includes a cylindrical housing 2 comprising two parts 4, 6 each being cylindrical and having a cavity 8, 10 within. The cavities 8,10 together constitute a chamber 12 in the assembled tool. A hollow shaft 14 connects to one part 6 of the housing and passes through the other part 4. In the tools described herein it will be understood that suitable sealing arrangements are provided at openings in the housing wall, such as that allowing passage of shaft 14 through housing part 4.

Outside the housing a threaded portion 16 of shaft 14 mounts a nut 18 for clamping parts 4 and 6 into sealing engagement. A sealing ring 20 (see FIG. 1C discussed below) is provided between parts 4, 6.

Each housing part 4, 6 has a circumferential sealing edge 22, 24 that engages the sealing ring 20. As suggested by arrows the clamping force C applied by tightening nut 18 keeps the chamber 12 sealed from the outside. This sealing can be important where the tool is deployed at depth, for example inside a tubular of an oil and gas well bore. Ingress of fluid from the outside could interfere with the use of the tool. External pressure (arrows P) will tend to force ring 20 inwards. However, as the area of ring 20 acted upon by clamping force C is greater than that of the outside edge 25 of the ring 20, a relatively lower clamping force C can withstand the effects of a relatively high pressure P. This is especially so where sealing ring 20 is thinner than suggested by this schematic view.

Inside chamber 12 a solid propellant 26 is placed at one end, in this example. The charge of propellant 26 constitutes a propellant source in this example. An ignition device 28 is located on the propellant 26 and can be set off by command signal from wiring 29 passing through shaft 14. A wireless arrangement could be used as an alternative means of signal transmission. On ignition, propellant 26 produces combustion products that increase the pressure inside chamber 12 until the seal provided by ring 20 and sealing edges 22, 24 is broken.

As shown in FIG. 1B the sealing ring has been removed by the action of the combustion products leaving a circumferential gap between sealing edges 22 and 24 that constitutes an outlet 30 from chamber 12. In this example the chamber outlet 30 defines a nozzle through which combustion products flow. Combustion products flow out of the outlet 30 as suggested by arrows X and Y, with the principal direction of the combustion products indicated by arrows Y. The flow (stream) of combustion products released as propellant 26 deflagrates can be used, for example, to sever a tubular into which the tool 1 has been placed.

Figure 1C:
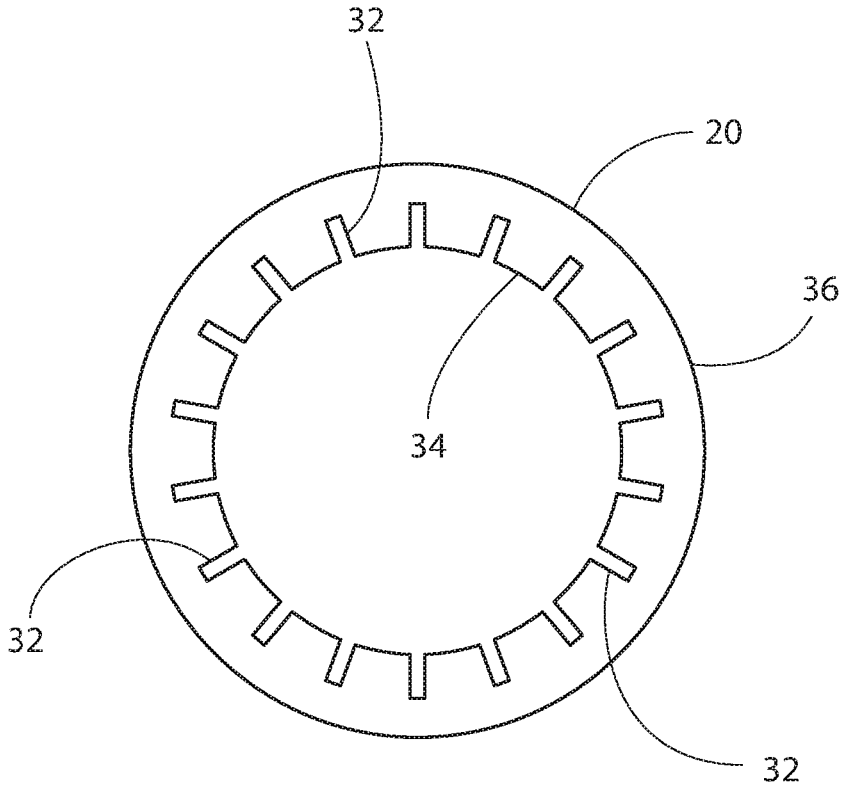
FIG. 1C shows a sealing ring.

FIG. 1C shows sealing ring 20 in plan view. The ring 20 may be of aluminium or aluminium alloy for example. In this example the ring has a series of radially extending slots 32 extending from the inner circumference 34 toward the outer circumference 36. These slots 32 weaken the ring 20 so that it may burst when pressure and the heat of combustion products are applied. The use of aluminium or aluminium alloy also allows the ring 20 to be melted or even to be consumed as a fuel by a flow of oxygen rich combustion products from a propellant. Thus, the ring 20 can be rapidly removed following ignition of the propellant.

Figure 2B:
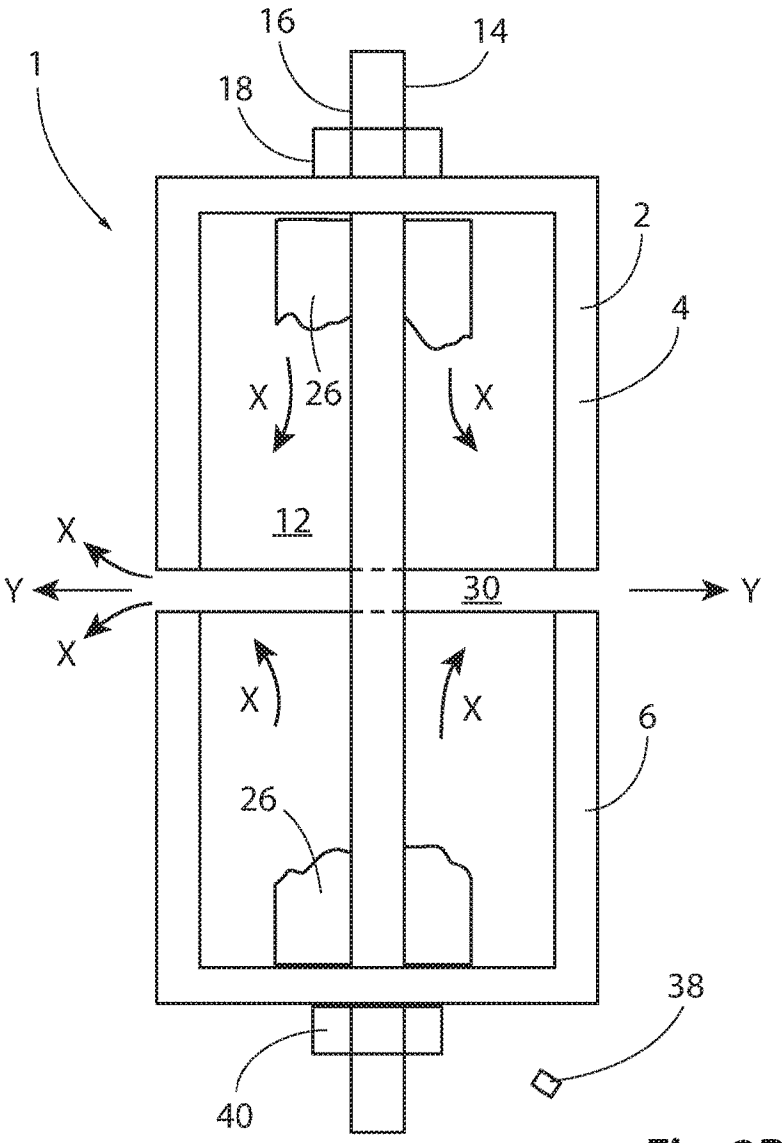
FIGS. 2A and 2B show in schematic cross section elevation an alternative tool to that shown in FIGS. 1A and 1B.
Figure 2A:
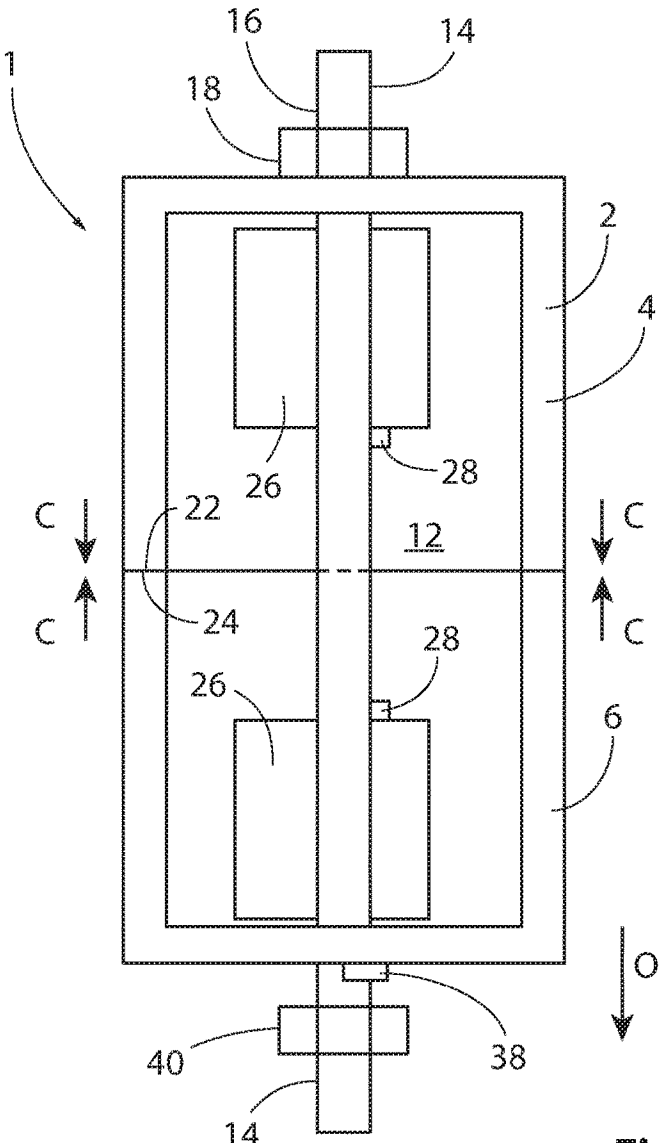

Schematic cross section views in FIGS. 2A, 2B show an alternative means of automatic opening of a chamber outlet. Like parts are numbered the same as in FIG. 1. As seen in FIG. 2A the cylindrical tool 1 has a housing 2 in two parts 4, 6. In this example sealing edges 22 and 24 are not provided with a sealing ring in-between, but seal one to the other, optionally with the aid of a sealing compound such as a grease. However, a ring such as shown in FIG. 1 may be employed. Other suitable sealing arrangements using O-rings (including with back-up rings), metal to metal seals and the like may also be used.

In FIG. 2A shaft 14 passes through the ends of both housing parts 4, 6, with part 6 prevented from moving in direction of arrow 0 by a stop, in this case a pin 38 inserted in shaft 14. Nut 18 acts to apply clamping force C between the housing parts 4, 6. Two charges of solid propellant 26 are provided in chamber 12, spaced apart with the chamber outlet 30 (see FIG. 2B) in-between. Each charge of propellant 26, in this example, is provided with its own ignition means 28.

On ignition of the charges of propellant 26 the resulting combustion products generate pressure in chamber 12, urging housing parts 4, 6 apart. The pressure generated exceeds the breaking strength of pin 38 which breaks off, allowing part 6 to move in opening direction O, until it is stopped by nut 40. Similar arrangements where the shaft and associated stops, spring biasing and the like are all arranged to be internal to the tool are also contemplated.

The open position is shown in FIG. 2B. Chamber outlet 30 has been opened by the action of combustion products flowing as suggested by arrows X and principal direction arrows Y. Chamber outlet 30 defines a nozzle. Chamber outlet 30 will remain open until the pressure within chamber 12 drops below that of the local external pressure.

Figure 3C:
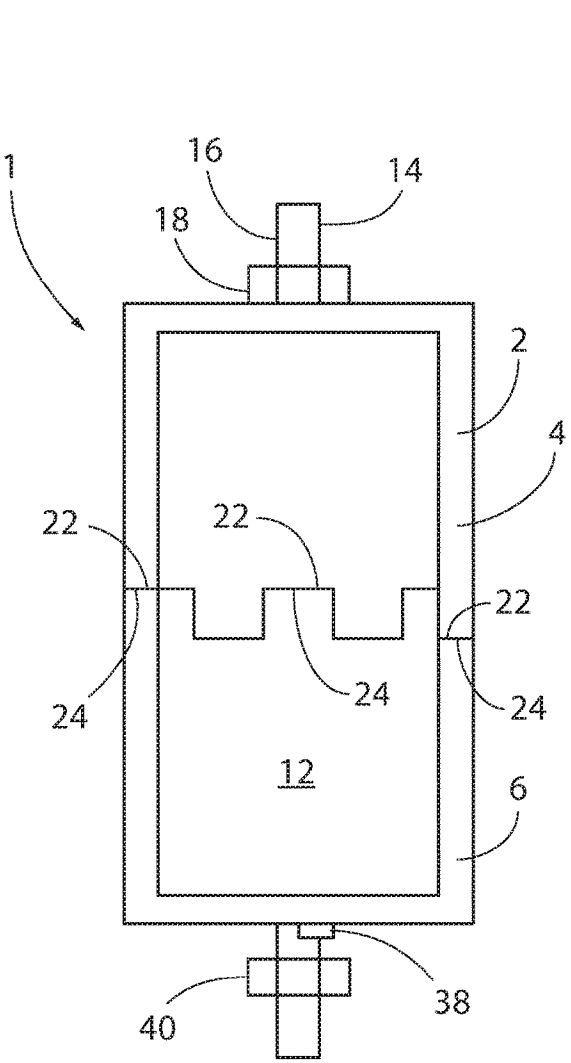
FIGS. 3A, 3B and 3C show in schematic cross section elevation alternative tools to those shown in FIGS. 1A and 1B.
Figure 3B:
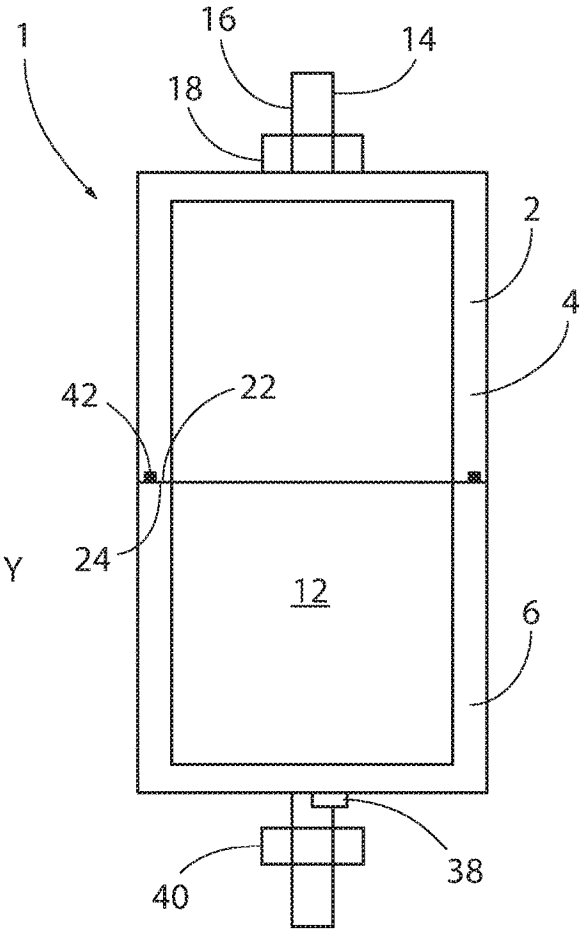
Figure 3A:
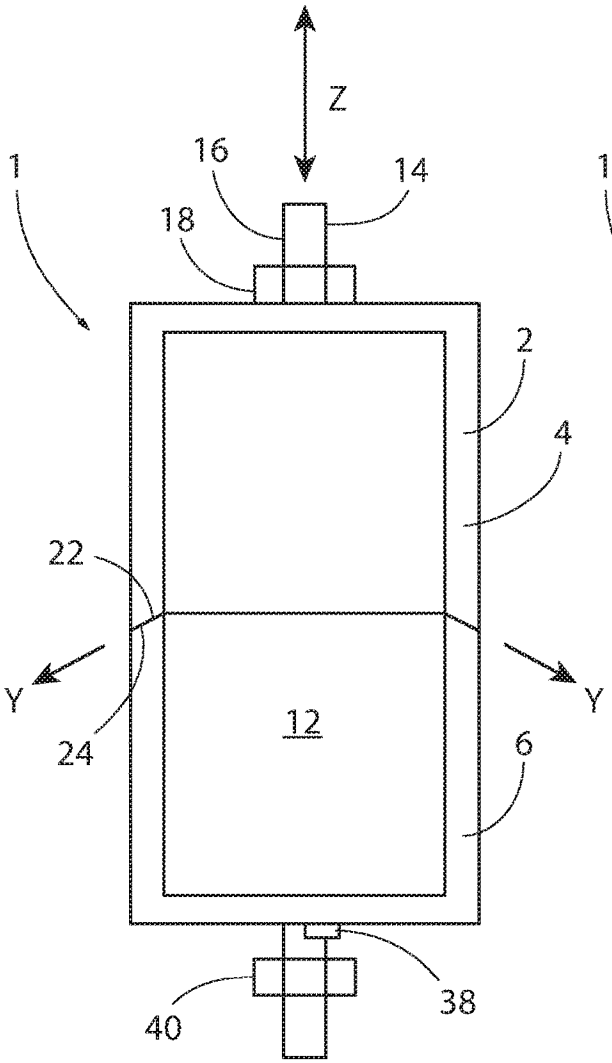

FIGS. 3A to 3C show similar arrangements to those of FIGS. 2A & 2B. Details of the shaft and propellant charges within chamber 12 are omitted from these schematic views.

In FIG. 3A the circumferential sealing edges 22 and 24 are not normal to the principal axis Z of the housing 2 but are angled downwards. As indicated by arrows Y this has the effect of changing the principal direction of the flow of combustion products when the tool is activated by ignition of the propellant within chamber 12.

In FIG. 3B an O-ring seal 42 is provided between sealing edges 22, 24, seated in a channel. Two or more O-rings and back-up rings, or metal to metal seals and the like can be used to suit the specific wellbore conditions in which the tool is placed.

Figure 4B:
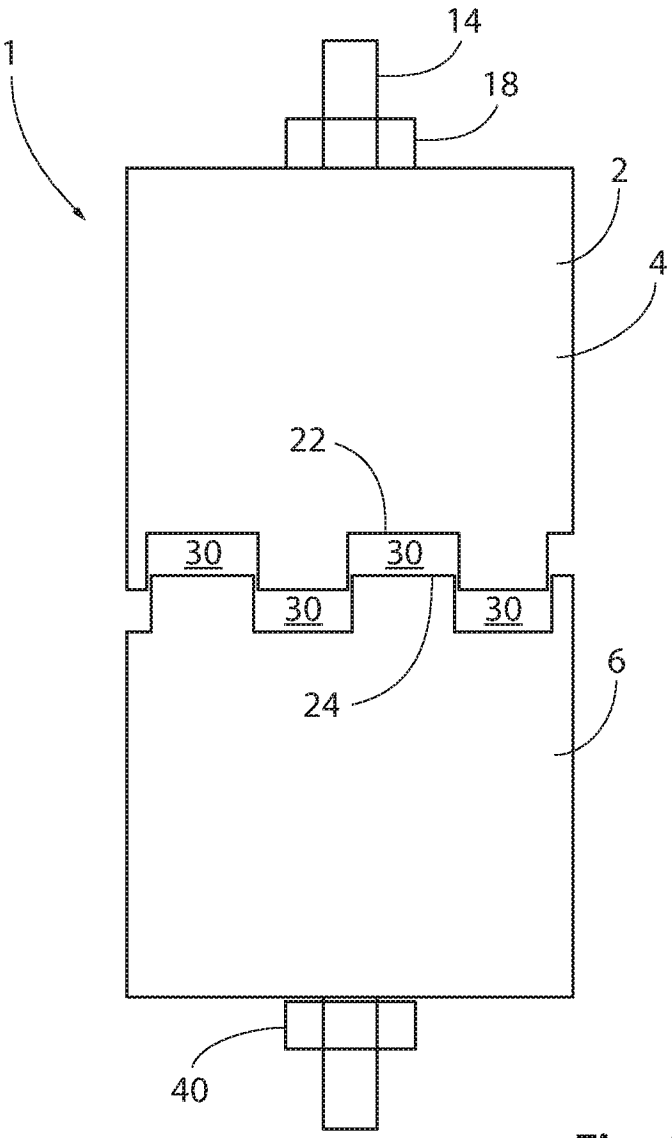
FIGS. 4A and 4B show in schematic elevation an alternative tool to that shown in FIGS. 1A and 1B.
Figure 4A:
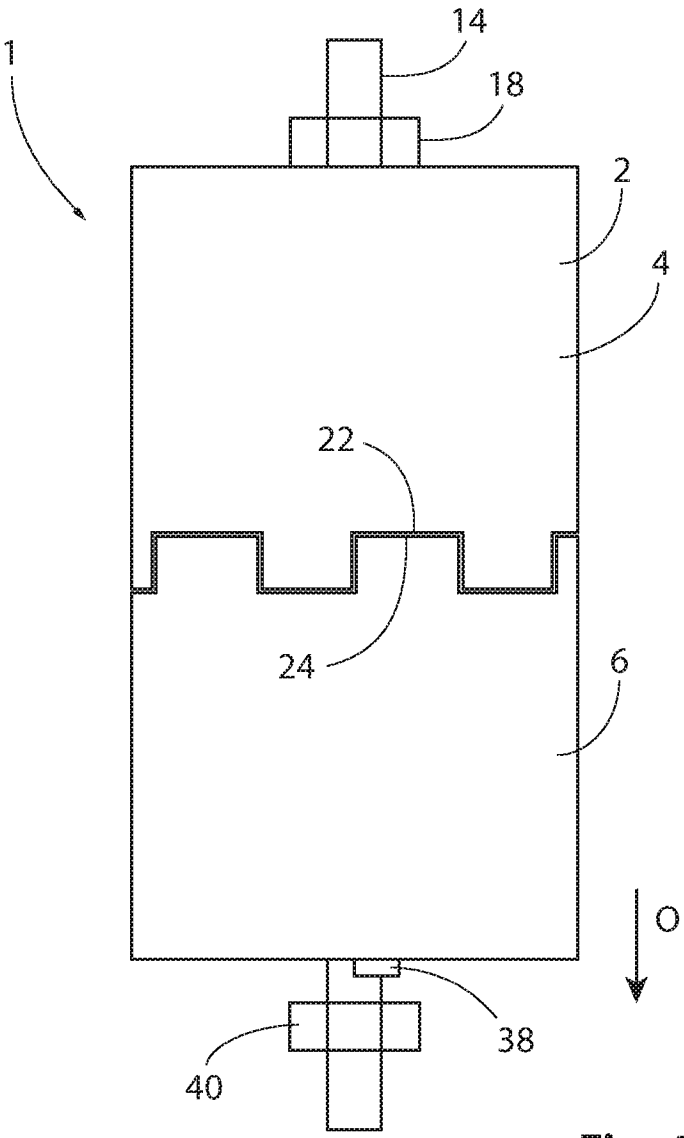

In FIG. 3C circumferential sealing edges 22, 24 are castellated. FIGS. 4A and 4B show external schematic elevations of the tool of FIG. 3C. In the closed position shown in FIG. 4A the sealing edges 22, 24 meet. Following ignition of propellant and breaking of pin 38, the open position of FIG. 4B is obtained. Alternating higher and lower chamber outlets 30 define nozzles which direct the flow of combustion products from the tool.

Figure 5B:
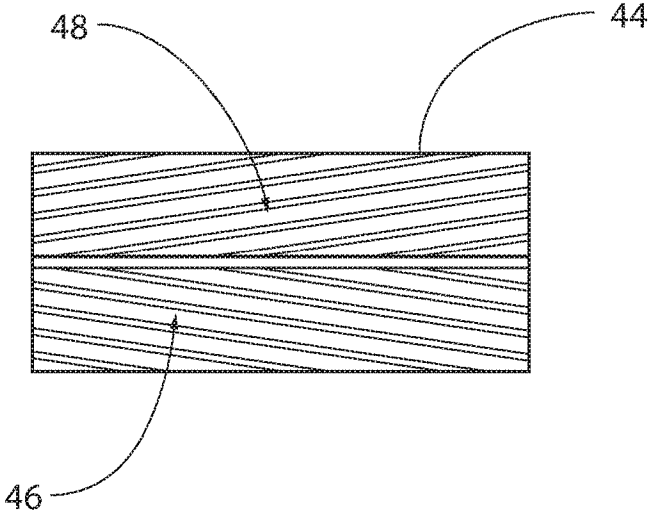
FIG. 5B shows a coupling component in schematic elevation.
Figure 5A:
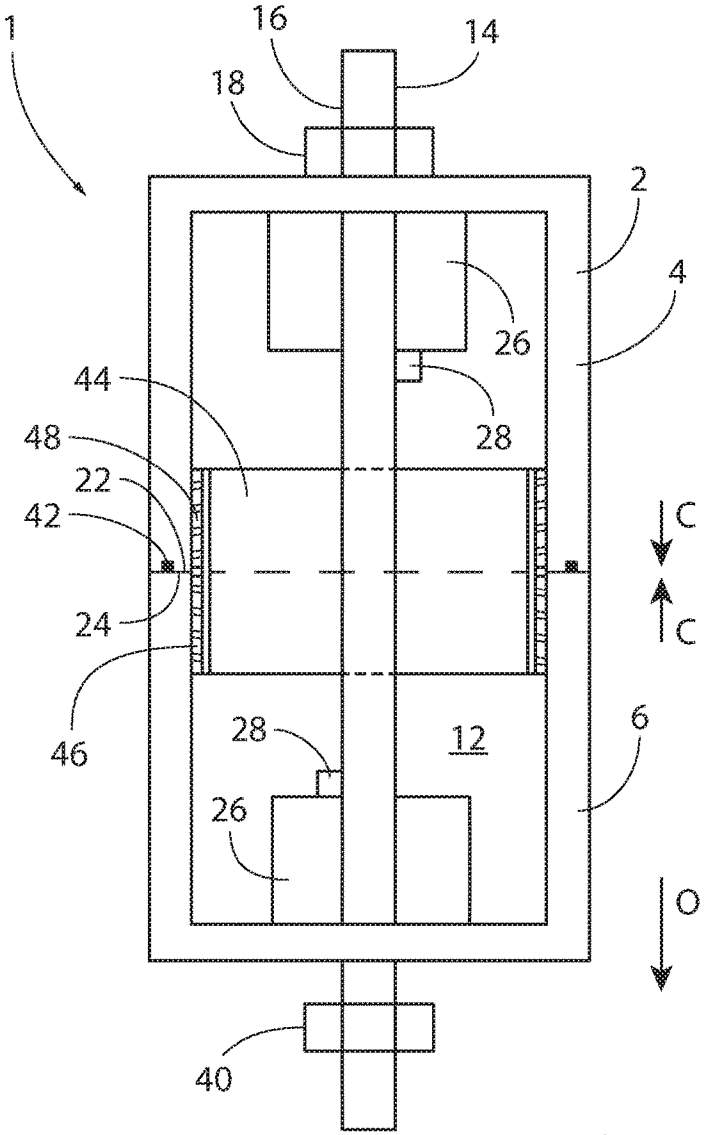
FIG. 5A shows in schematic cross section elevation an alternative tool to that shown in FIGS. 1A and 1B.

In FIG. 5A an alternative arrangement making use of a threaded coupling is depicted in schematic elevation cross section. The arrangement is similar to that shown in FIGS. 2A and 2B, except that a stop in the form of a pin 38 (FIG. 2A) is not provided. In this example an internal coupling 44 with external screw threads 46, 48 is provided around the joint between housing parts 4, 6. The coupling is screwed onto corresponding threads on the inside of parts 4, 6. Clamping force C is provided by screwing the parts 4, 6 together outside coupling 44. In this arrangement nut 18 may act only as a stop to motion of housing part 4. On ignition of charges of propellant 26 the pressure from the combustion products in chamber 12 will urge part 4 in the direction O, breaking (bursting) the coupling 44. Coupling 44 is also shown in schematic elevation view FIG. 5B.

Figure 6B:
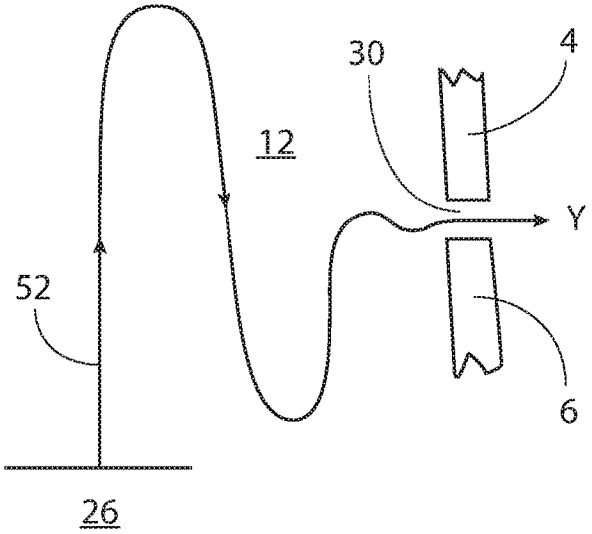
FIG. 6B illustrates the flow of a stream of combustion products.
Figure 6A:
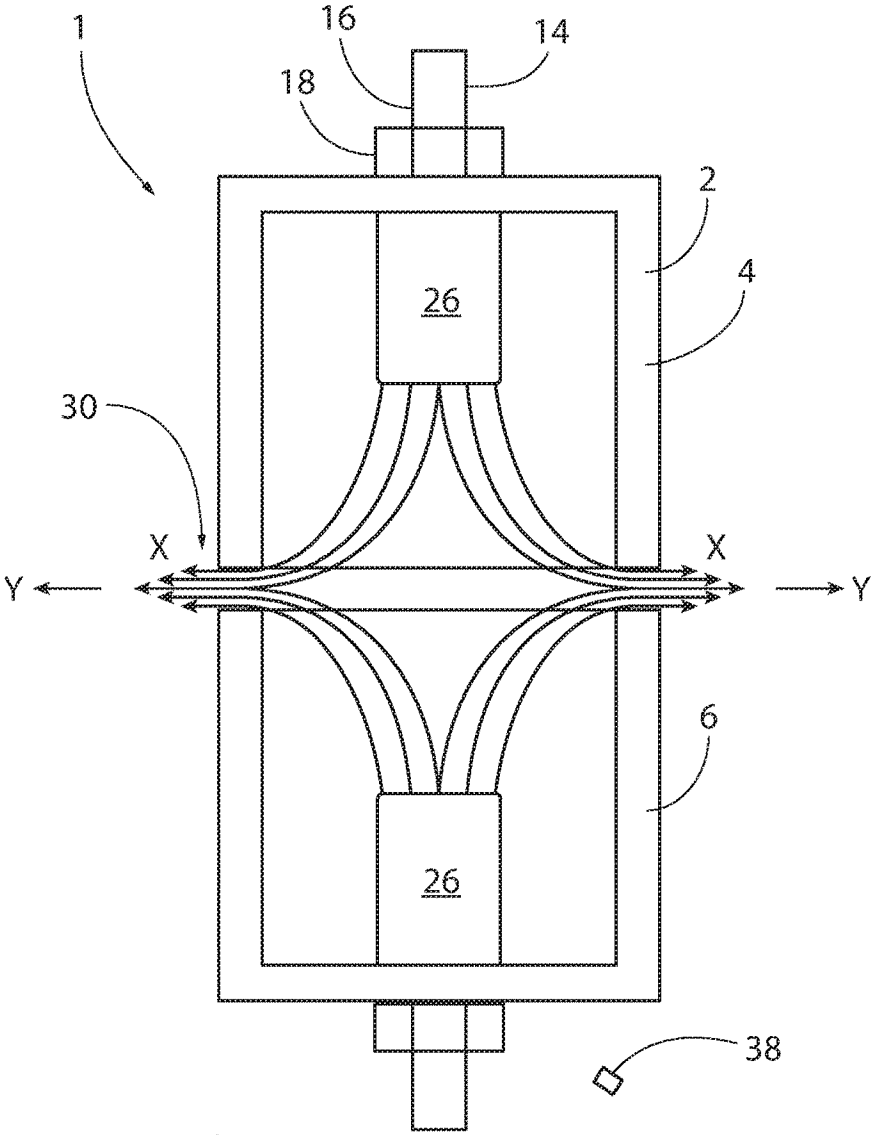
FIG. 6A shows in schematic cross section elevation a tool in use.

FIG. 6A shows in schematic elevation cross section, an arrangement such as that of FIG. 2B, to illustrate a benefit of using two charges of propellant 26, spaced apart and with the chamber outlet 30 defining a nozzle in between. In this depiction the part of shaft 14 within the chamber 12 is not shown (see FIG. 2B). The use of such an arrangement of propellant charges has been found beneficial. A strong consistent and well directed flow of combustion products (arrows X) leaves chamber outlet 30, all around the circumference. Without wishing to be bound by theory, the flow (stream) of combustion products (gases, solid particles, liquid droplets and in some cases plasma) from each propellant charge appear to interact—one against the other—to produce results that may be more consistent than those of arrangements using only one propellant portion in the chamber (e.g. as in FIG. 1A).

FIG. 6B illustrates the postulated path 52 of a particle in the flow of combustion products. After leaving the surface of a charge of propellant 26 the particle is slowed and repelled by the flow of combustion products coming from the other charge of propellant. As it returns it is slowed and repelled by the combustion products flowing from its original propellant charge. This continues in an oscillatory fashion until the particle exits the chamber 12, typically in the direction Y.

Figure 7B:
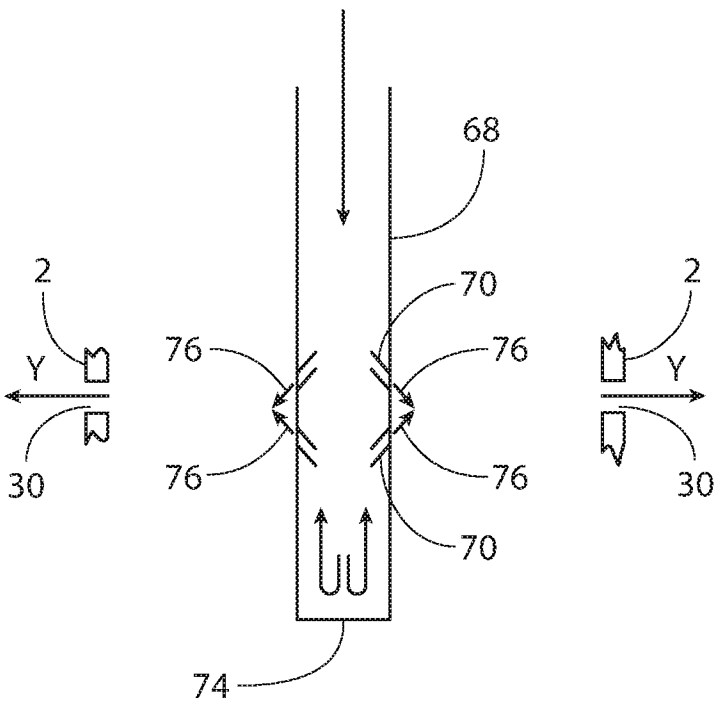
FIG. 7B shows an alternative arrangement for the internals of the tool of FIG. 7A.
Figure 7A:
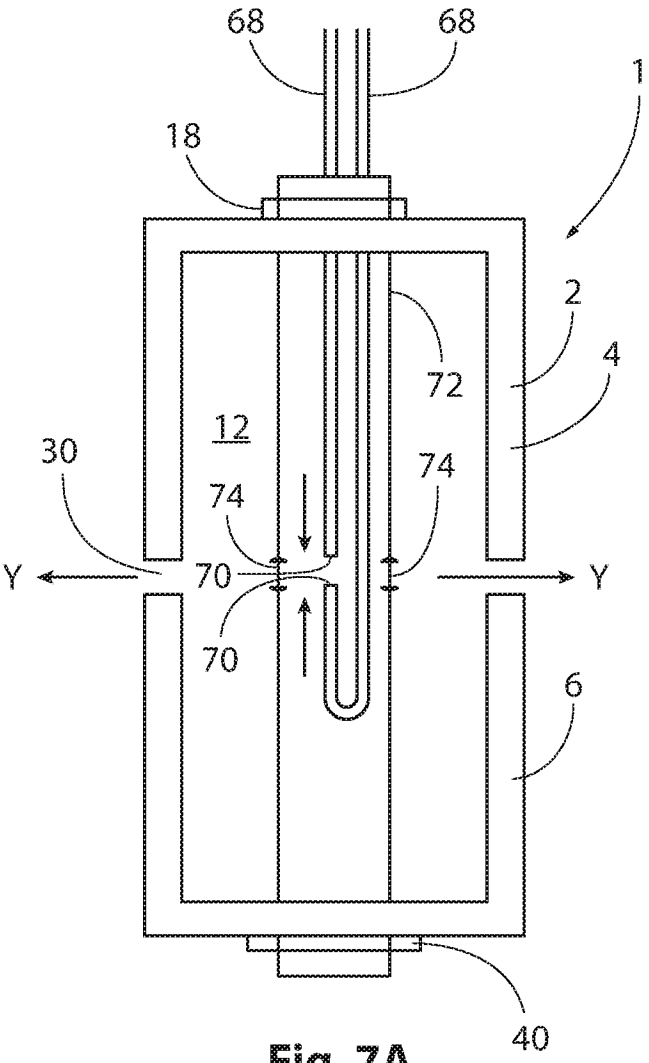
FIG. 7A shows in schematic cross section elevation an alternative tool to that shown in FIGS. 1A and 1B.

FIG. 7A shows schematically a tool 1 making use of propellant sources that can be fed with propellant from outside the housing. FIG. 7A shows a view generally similar to that of FIG. 2B. The housing 2 of tool 1 has opened automatically with combustion products exiting from the circumferential chamber outlet 30 of chamber 12.

In this example the propellant 26 is a liquid, gel or gas composition (that may contain solids) and is being fed into chamber 12 via feed pipes 68 which have openings 70 (pipe ends, which may be shaped nozzles to optimise combustion) facing each other. The feed pipes 68 are within a cylindrical heat shield 72 having a number of outlets 74 (only two indicated) around its circumference and generally opposite the chamber outlet 30 from chamber 12.

In this example the heat shield 72 serves the same function as shaft 14 shown in the tool of FIG. 2, including holding the two housing parts 4, 6 together after opening. Alternatively, for example where the heat shield 72 is divided in two by an outlet 74 that is circumferential, a shaft of the same form as that shown in FIG. 2 may be fitted.

Openings 70 constitute propellant sources for this tool. The combustion products formed at openings 70 pressurise the chamber 12, both inside and outside heat shield 72 and then provide a stream of combustion products exiting (arrows Y) the housing 2.

Feed pipes 68 may be supplied with propellant from a common source e.g. a tank, or the supply may be from separate sources if the compositions of the propellant supplied is different for each opening 70.

In some examples the propellant fuel and propellant oxidant may be supplied via separate feed pipes to openings 70.

Not shown in this figure is the ignition device, as that may be destroyed following ignition of the propellant. Typically, the device would be located close to the openings 70 in feed pipes 68. As discussed above with respect to other embodiments the ignition device can be set off by command signal from outside the housing 2.

FIG. 7B shows in schematic detail an alternative propellant source arrangement. Other parts of the tool are not shown apart from the location of the chamber outlet in the chamber wall. A feed pipe 68 has a closed end 74 and openings 70 that direct feed as suggested by arrows 76. On ignition of propellant outside the feed pipe 68, streams of combustion products will be directed as indicated by arrows 76 so as to interact with each other, ultimately producing a stream of combustion products (principal direction indicated by arrows Y) emanating from chamber outlet 30 of housing 2. By moving the tool (in any direction) relative to a target a larger portion (e.g. a length) of material may be removed. Feeding propellant into the tool can allow a longer burn time following ignition.

Figure 8A:
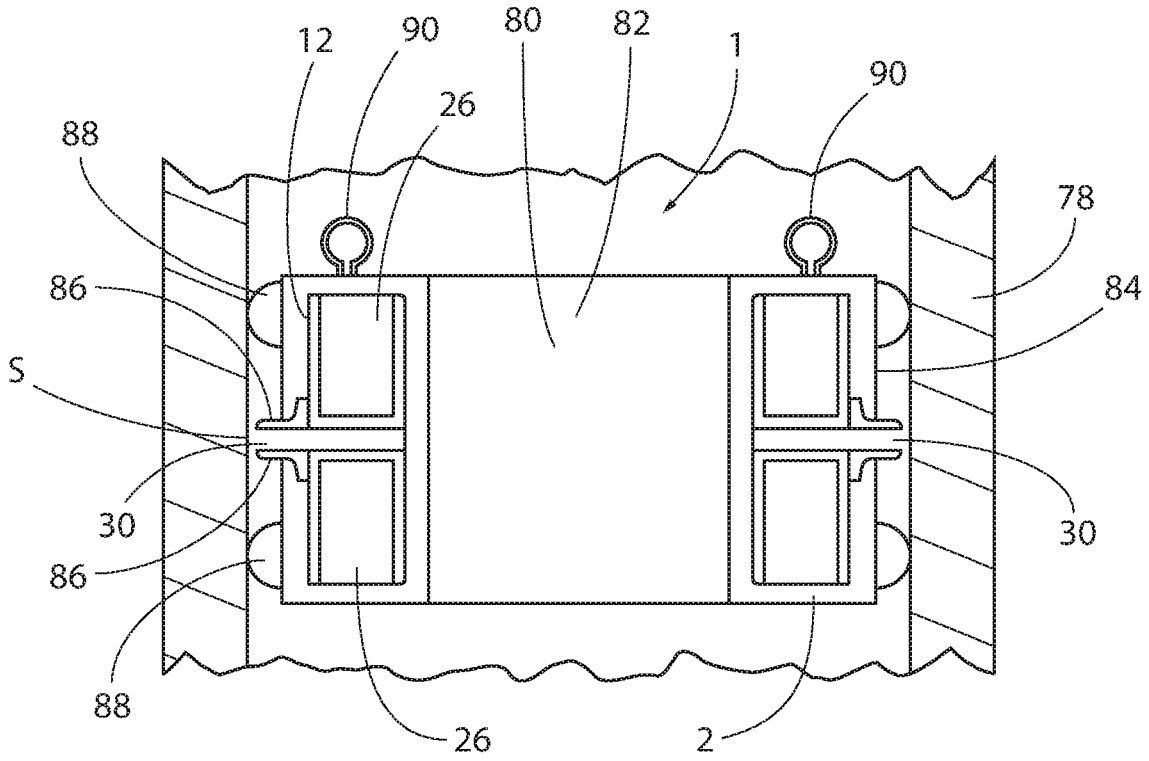
FIG. 8A shows in schematic cross section elevation an alternative tool to that shown in FIGS. 1A and 1B, fitted inside a pipe to be severed.
Figure 8B:
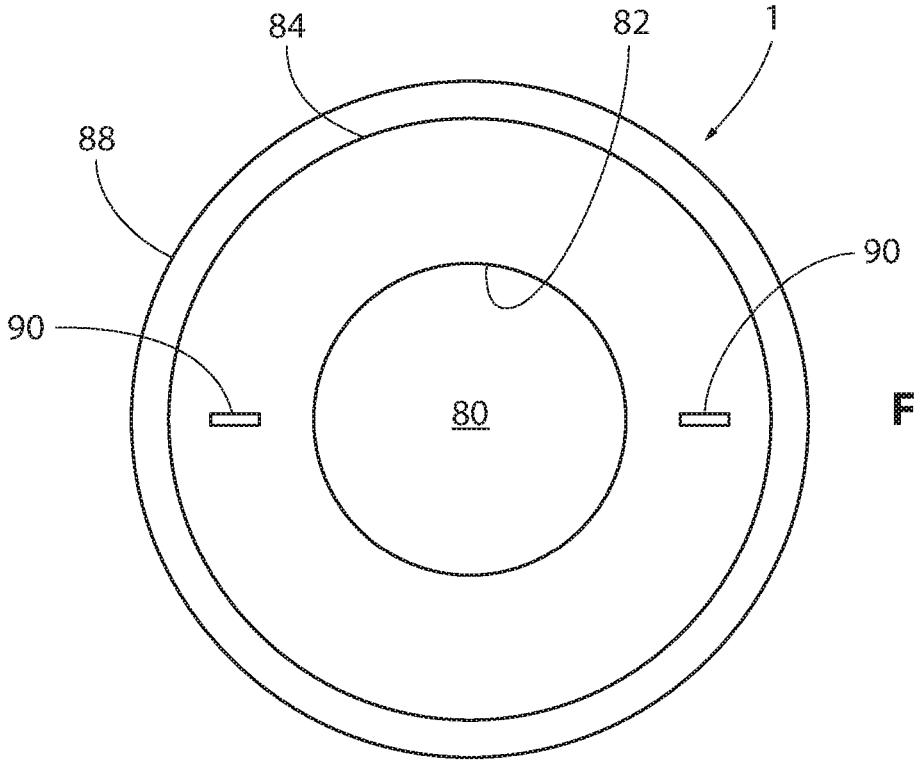
FIG. 8B shows a plan view of the tool of FIG. 8A.

FIG. 8A shows in in schematic cross section elevation a tool 1 deployed inside a section of pipe 78. The same tool is shown in the schematic plan view of FIG. 8B. The tool 1 is cylindrical in form with an axially extending cylindrical passage 80 passing through it. A chamber 12 extends around the whole circumference of the tool 1, between the inner 82 and outer 84 walls.

In this example the chamber 12 includes two spaced apart charges of propellant 26, each extending around the whole circumference.

Chamber outlet 30, shown open in FIG. 8A, extends around the whole circumference of outer wall 84. Before ignition of propellant 26 the chamber outlet 30 could be closed with a wall portion of a suitable sacrificial material. Alternatively, other opening mechanisms, as discussed herein, may be employed in a tool of this general form.

Chamber outlet 30 will allow a stream of combustion products emanating from propellant charges 26 to sever pipe 78 circumferentially at position S.

Also shown in this figure are nozzle components 86 fitted to chamber outlet 30 and extending it towards the target pipe 78. The nozzle components enable more precise cutting of the pipe 78. Nozzle components 86 may be of an alloy chosen to survive the harsh conditions following ignition of propellant. The location of tool 1 within the pipe 78 is aided by the provision of resilient sealing members 88 (e.g. of an elastomer) that run around the circumference outer wall 84. Where a larger (or smaller) diameter pipe is to be severed, the nozzle components and the sealing members 88 may be sized to suit the task.

One or more lifting eyes 90 may be used to attach a cable or the like to aid retrieving the tool after use.

Figure 8C:
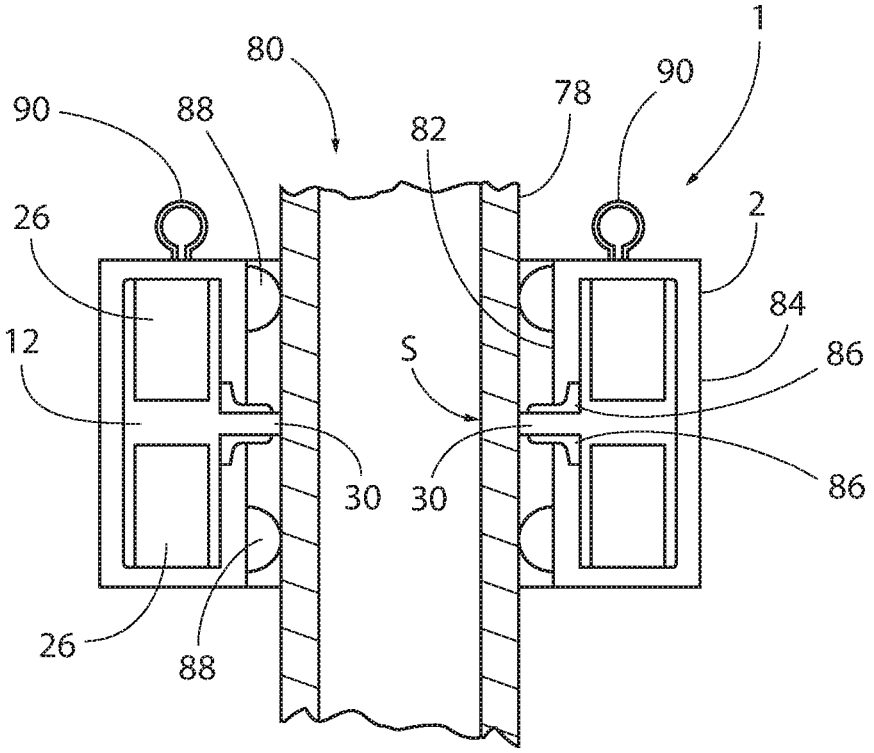
FIG. 8C shows in schematic cross section elevation a similar tool to that shown in FIGS. 8A and 8B but configured and fitted about a pipe to be severed.

FIG. 8C shows in schematic cross section elevation a tool 1 of the same general form as that shown in FIGS. 9A and 9B, but configured for severing an article such as pipe 78, that passes through central passage 80. To that end circumferential nozzle 30 and resilient sealing members 88 are located on inner wall 82.

The invention claimed is:

1. A tool for manipulating a target with combustion products from a propellant, the tool comprising:

a housing defining a chamber;

a propellant source located within the chamber;

an ignition mechanism for igniting propellant at the propellant source; and at least one chamber outlet for combustion products from the propellant source;

wherein the chamber housing is formed of at least two parts that are moveable one relative to the other, to reveal the chamber outlet or a plurality of chamber outlets;

wherein the tool is configured to automatically open the chamber outlet or the plurality of chamber outlets from a closed condition, following ignition of the propellant at the propellant source; and wherein automatic movement of the housing parts following ignition is achieved by the pressure generated by the combustion products overcoming a compressive clamping force that holds the two chamber housing parts together.

2. The tool of claim 1 wherein each chamber outlet defines or comprises a nozzle for directing combustion products at a target; and wherein each chamber outlet is configured for fitting one of a range of nozzle components.

3. The tool of claim 1 wherein the at least two parts of the housing each have a sealing edge that defines an opening into a cavity that constitutes part of the chamber when the tool is assembled for use.

4. The tool of claim 1 wherein one of the at least two housing parts is in the form of an end having a sealing edge and the other has a corresponding sealing edge that defines an opening into a cavity that constitutes part or all of the chamber when the tool is assembled for use.

5. The tool of claim 3 wherein the sealing edges of two parts of the chamber housing are circumferential and a seal is clamped between them.

6. The tool of claim 1 wherein the two parts of the housing are mounted to a shaft configured to allow one part to be moved towards or away from the other, along the shaft.

7. The tool of claim 6 wherein one of the two housing parts has a threaded bore mounted to a threaded portion of the shaft, to allow a screwing together action and application of a clamping force as desired.

8. The tool of claim 6 wherein one or both of the two housing parts is mounted for sliding engagement to the shaft.

9. The tool of claim 6 wherein the automatic opening is achieved by overcoming a clamping force applied along the shaft by a spring.

10. The tool of claim 6 wherein one of the two housing parts is held at a position along the shaft by a stop until the pressure generated by combustion products overcomes the stop, thereby allowing the housing part to move along the shaft.

11. The tool of claim 1 wherein the two housing parts are clamped together by means of an outer or an inner coupling.

12. The tool of claim 11 wherein the coupling is circumferential around the outside of the housing or circumferential around the inside of the chamber.

13. The tool of claim 11 wherein the coupling is a threaded coupling, screw fitting to both parts of the housing.

14. The tool of claim 13 wherein the coupling is an inner coupling and the screw threading on one housing part is opposite to that of the other housing part.

15. A method for manipulating a target with combustion products from a propellant, the method comprising:

a) providing a tool comprising:

a housing defining a chamber;

a propellant source located within the chamber;

an ignition mechanism for igniting propellant at the propellant source; and at least one chamber outlet for combustion products from the propellant source;

wherein the chamber housing is formed of at least two parts that are moveable one relative to the other, to reveal the at least one chamber outlet;

wherein the tool is configured to automatically open the chamber outlet from a closed condition, following ignition of propellant at the propellant source;

b) locating the tool in proximity to the target; and c) igniting propellant with the ignition mechanism;

wherein the automatic opening of the chamber outlet includes movement of the at least two housing parts following ignition, achieved by the pressure generated by the combustion products overcoming a compressive clamping force that holds the two chamber housing parts together.

* * * * *